US005556046A

United States Patent [19]

Irmen et al.

[11] Patent Number: 5,556,046

[45] Date of Patent: Sep. 17, 1996

[54] APPARATUS FOR PREPOSITIONING A YARN END ON SPINNING COPS FOR SUBSEQUENT UNWINDING IN A BOBBIN WINDING MACHINE

[75] Inventors: Wolfgang Irmen, Mönchengladbach; Helmut Kohlen, Erkelenz, both of Germany

[73] Assignee: W. Schlafhorst AG & Co., Moenchengladbach, Germany

[21] Appl. No.: 498,998

[22] Filed: Jul. 6, 1995

[30] Foreign Application Priority Data

Jul. 12, 1994 [DE] Germany ..... 44 24 462.2

[51] Int. Cl.[6] ..... B65H 54/00; B65H 69/04

[52] U.S. Cl. ..... 242/18 R; 242/18 EW; 242/35.6 E

[58] Field of Search ..... 242/35.6 E, 18 R, 242/18 EW, 35.5 A, 35.5 R, 35.6 R

[56] References Cited

U.S. PATENT DOCUMENTS

| | | | |
|---|---|---|---|
| 4,901,931 | 2/1990 | Mista | 242/18 R |
| 4,909,451 | 3/1990 | Kuepper et al. | 242/35.6 E X |
| 4,928,903 | 5/1990 | Wirtz et al. | 242/35.6 E X |
| 5,050,811 | 9/1991 | Nishimura et al. | 242/18 R |
| 5,106,027 | 4/1992 | Wirtz et al. | 242/35.6 E X |
| 5,232,171 | 8/1993 | Hensen | 242/35.6 E X |

FOREIGN PATENT DOCUMENTS

| | | |
|---|---|---|
| 7531710.1 | 3/1977 | Germany . |
| 3608862A1 | 9/1987 | Germany . |
| 3726338A1 | 2/1989 | Germany . |
| 3924000A1 | 1/1990 | Germany . |
| 3-120174 | 5/1991 | Japan . |

*Primary Examiner*—Michael R. Mansen
*Attorney, Agent, or Firm*—Shefte, Pinckney & Sawyer

[57] ABSTRACT

An apparatus for prepositioning a yarn end on a spinning cop for subsequent unwinding in a bobbin winding machine accomplishes improved functional capabilities by providing a positionally changeable yarn guiding device as well as a yarn retaining device. A part of the yarn guiding device which comes into contact with the yarn can be moved from an active position below the upper edge of the cop into an inactive position above the cop nose. The yarn retaining device has an opening for yarn entry. By way of a control device, the yarn guiding device is controlled to take up the inactive position following the placement of nose windings about the cop nose, and a device for inserting the remaining yarn end portion into the tubular interior of the cop is then activated and the yarn retaining device is taken out of contact with the upper edge of the cop. Preferably, the yarn inserting device comprises a tubular arbor which can be positioned centrally above the cop to function as a yarn end blower nozzle.

12 Claims, 5 Drawing Sheets

APPARATUS FOR PREPOSITIONING A YARN END ON SPINNING COPS FOR SUBSEQUENT UNWINDING IN A BOBBIN WINDING MACHINE

FIELD OF THE INVENTION

The present invention relates to an apparatus for prepositioning an end of the yarn on spinning cops for subsequent unwinding in a bobbin winding machine and more particularly to such an apparatus comprising a drive for rotating the cop around its longitudinal axis, a suction nozzle with a suction slit for aspirating and holding the yarn end to be positioned, a cutting device for cutting the yarn end to length, a yarn guide means for delivering the yarn to the nose of the cop for placing nose windings of the yarn upon withdrawal from the suction nozzle, and means for inserting the remaining yarn end portion into the interior of the tube of the spinning cop.

BACKGROUND OF THE INVENTION

As a general rule, the terminal end of the yarn on a spinning cop is wound by the spinning frame in such a way that it cannot easily be freed at a winding station of a bobbin winding machine and transferred to its appropriate yarn handling members. For this reason it is typically necessary to provide a device or apparatus disposed between the spinning frame and the winding station of the winding machine for prepositioning the yarn end for the subsequent unwinding process. Various preparation devices of this type are known from a number of patents. Basically, in such devices, the yarn end is initially loosened and aspirated into the suction slit of a suction nozzle by essentially pneumatic means of these preparation devices which are, if necessary, aided by means which act mechanically on the cop. During this process, the cop is turned opposite to the winding direction of the yarn to make grasping of the yarn easier and to enable the required length of the yarn to be freed after it has been grasped. Grasping of the yarn end is usually monitored by sensors. A cutting device, disposed at a fixed distance from the suction slit, is used for the exact cutting to a consistent length of the yarn end in order to always have a constant yarn length available for the subsequent yarn prepositioning.

Prepositioning of the yarn can take place in various ways but, as already mentioned, must always assure that problem-free release of the yarn end as well as its supply to the appropriate grasping device of the winding station is possible.

One manner of prepositioning the yarn end on the cop is to wind an endwise length of the yarn about a nose portion of the cop. In doing so, it is possible that the yarn may slacken in traveling from the preparation device to the winding station, particularly in the case of relatively slick yarns. Also, a length of the yarn may be inserted into the cop tube but may be insufficient in length particularly with relatively small cops. Further, the yarn length available for insertion into the tube is limited by the distance between the tip of an arbor of a pallet on which cops are customarily placed and the nose of the cop tube, which must be taken into consideration in order to prevent the yarn end from being jammed between the arbor and the tube thereby preventing the yarn from reaching the yarn handling devices of the winding station.

One possibility for introducing a greater yarn length into the tube is described in German Patent Publication DE 41 14 758 A1, wherein the yarn end is aspirated into an air duct of the arbor. Appropriate retaining elements are located inside this air duct to prevent the continued aspiration of the yarn end.

A further possibility to increase the yarn length provided for grasping at the winding machine is described in Japanese Patent Publication JP 3-120 174 A, wherein a nose winding of yarn is first placed on the nose of the cop tube and subsequently a length of the remaining yarn is aspirated into the tube. In the apparatus which performs this operation, a rod extends from a first station at which the yarn end is sought and grasped to an adjacent station at which the yarn end is deposited. This rod is disposed in the path of the yarn extending between a slit of a suction nozzle, which also extends between these two stations, and the cop itself. The yarn is therefore placed around the rod. The rod is disposed at an appropriate height such that its lower edge is located in the area of the cop nose to be ready for winding. A nose winding is placed on the cop nose with the aid of the rod by rotating the cop in the station in which the yarn deposit is to take place. After cutting the yarn end, the remaining yarn end is aspirated into the tube interior of the cop by means of an air duct extending through the cop and through the arbor and base plate of a pallet supporting the cop. As a result, the loop closes around the rod. The cop is subsequently moved on and drawn over the end of the rod. Because of this relative movement between the cop and the rod, it is possible that the yarn end brought into the tube may inadvertently be pulled out again if the yarn is snagged on the rod, for example because of an unevenness on the rod.

SUMMARY OF THE INVENTION

It is accordingly an object of the present invention to provide a device for prepositioning a yarn end on a spinning cop to facilitate subsequent unwinding in a bobbin winder, having an improved functionality for depositing a yarn end as a nose winding and in the cop tube.

Briefly summarized, this object is achieved in accordance with the present invention by providing an apparatus for prepositioning a yarn end on a tubular spinning cop which basically comprises a drive for rotating the cop about its longitudinal axis at a cop preparation station, a suction nozzle stationarily disposed at the cop preparation station for aspirating and holding the yarn end, a cutting device for cutting the yarn end to length, a yarn guide means for delivering a first portion of the yarn end to the nose portion of the cop for placing nose windings of the yarn thereabout, and means for inserting a remaining portion of the yarn end into a tubular interior of the spinning cop.

According to the present invention, the nozzle has a yarn receiving slit extending lengthwise of the cop to a terminal end of the slit axially beyond a nose portion of the cop and the yarn guide means is movable relative to the cop at the cop preparation station between an inactive position spaced axially from the nose portion of the cop and an active position generally alongside the nose portion of the cop. Yarn retaining means is provided to be selectively movable into and out of contact with the nose portion of the cop and has an opening for delivery of the yarn end therethrough to the nose portion of the cop. Means are also provided for controlling movement of the yarn guide means into the active position during placement of nose windings about the portion of the cop and the inactive position after placement of the nose windings and for controlling activation of the yarn inserting means and movement of the yarn retaining means out of contact with the nose portion of the cop after movement of the yarn guide means into the inactive position.

The provision of a positionally changeable arrangement for the yarn guiding means permits the yarn end remaining after placement of the nose windings to be deposited in the interior of the cop tube without it being necessary to place a loop over the yarn guiding means, as was the case in the prior art. As a result, the yarn end has no contact at all with the yarn guide means after it has been completely prepositioned. Also, the separate yarn retaining means is not located between the yarn and the tube, but above them. Thus, it is no longer necessary with the instant invention to move parts out of a loop formed between the nose windings and the yarn section deposited in the yarn interior, thereby eliminating the risk of destroying the intended desired yarn deposition in the course of this relative movement.

Furthermore, with the device in accordance with the present invention, the remaining yarn end is automatically placed directly over the center of the opening of the cop tube in the course of further rotation of the cop following the formation of the nose winding and it can therefore be reliably inserted into the cop tube. In the aforementioned prior art, not only is the rod accomplishing the yarn guidance in the way of placing the yarn end exactly over the tube nose, it is also additionally required in the prior art to move the suction slit along the tube to a location above the tube nose. In contrast thereto, it is possible in connection with the instant invention to shorten the suction slit and to position it in a stationary location alongside the cop to be prepared with the slit terminating next to the tube nose, although at a slightly higher level. In this manner, it is possible to perform the grasping and aspiration of the yarn end as well as the subsequent prepositioning thereof on the spinning cop at the same station. Furthermore, the suction air losses are reduced by the shortened suction slit or alternately the aspiration force required for grasping the yarn is increased.

The exact positioning of the yarn end directly over the tube nose makes it possible to blow the yarn end into the tube interior, instead of aspirating it. In turn, it is possible to omit a continuous bore in the pallet or other cop holder, since it is possible to let the blown-in air escape by an appropriate design of the arbor of the pallet below the tube base, e.g., by forming the arbor of a ribbed configuration, which avoids the further problems of the prior art in which the air duct of the pallet can become clogged by dirt, lint, or debris from the underside of the pallet in the course of rugged textile operations. In addition, improved access to the cop from the top is possible in the course of aspirating the transport devices disposed below the caddies.

Also, the blower nozzle can be obliquely disposed in the direction toward the opening of the yarn retaining means to aid in moving the yarn end from a position extending through the opening of the yarn retaining means, to the upper tube opening of the spinning cop.

The present invention also permits an arbor to be arranged above the cop nose which additionally increases the dependability of positioning the yarn end portion to be inserted into the cop tube in respect to the position in the longitudinal axis of the tube. By winding at least a part of the yarn end portion to be inserted into the tube onto this arbor, it is also possible to avoid the necessity of supplying a longer yarn section through the opening of the yarn retaining means.

Delivery of the yarn section wound on the arbor into the tube can be accomplished either by means of adjoining nozzles or advantageously by designing the arbor itself as a nozzle. In each case, the blown air flow should directly strike the yarn section wound on the arbor in order to assure a proper yarn conveyance and also to reduce the required clock time for the operation.

Since the arbor performs its function simultaneously with the yarn retaining means, it is advantageous to connect both parts with each other. The yarn retaining means can at the same time take over the function of a centering flap which assures that the axis of rotation of the cop is fixed when the cop is turned during the search for the yarn.

The disposition of the yarn guiding means and yarn retaining means on a common pivot axis represents a simple construction of the device in accordance with the invention.

If the conveyance of the yarn end into the tube interior by means of blown air takes place from above, it is possible to arrange the device directly on the straight transport path of the cop-mounted caddies. A conveyor belt which transports the caddies by means of a frictional connection does not need to be interrupted, which would be necessary in connection with the prior art.

A reversible rotary drive for the cops is required in the device in accordance with the present invention since the yarn search and subsequent deposition of the yarn take place at the same station. By adjusting the number of cop revolutions, it is possible to exactly fix the number of nose windings and therefore also the length of the yarn end brought into the tube interior. The latter is of importance particularly because the yarn end is not intended to reach the arbor of the pallet, because then jamming of the yarn end would be unavoidable.

The invention will be explained in detail below by means of exemplary embodiments shown in the drawings.

DESCRIPTION OF THE PREFERRED EMBODIMENTS

Figure 1:
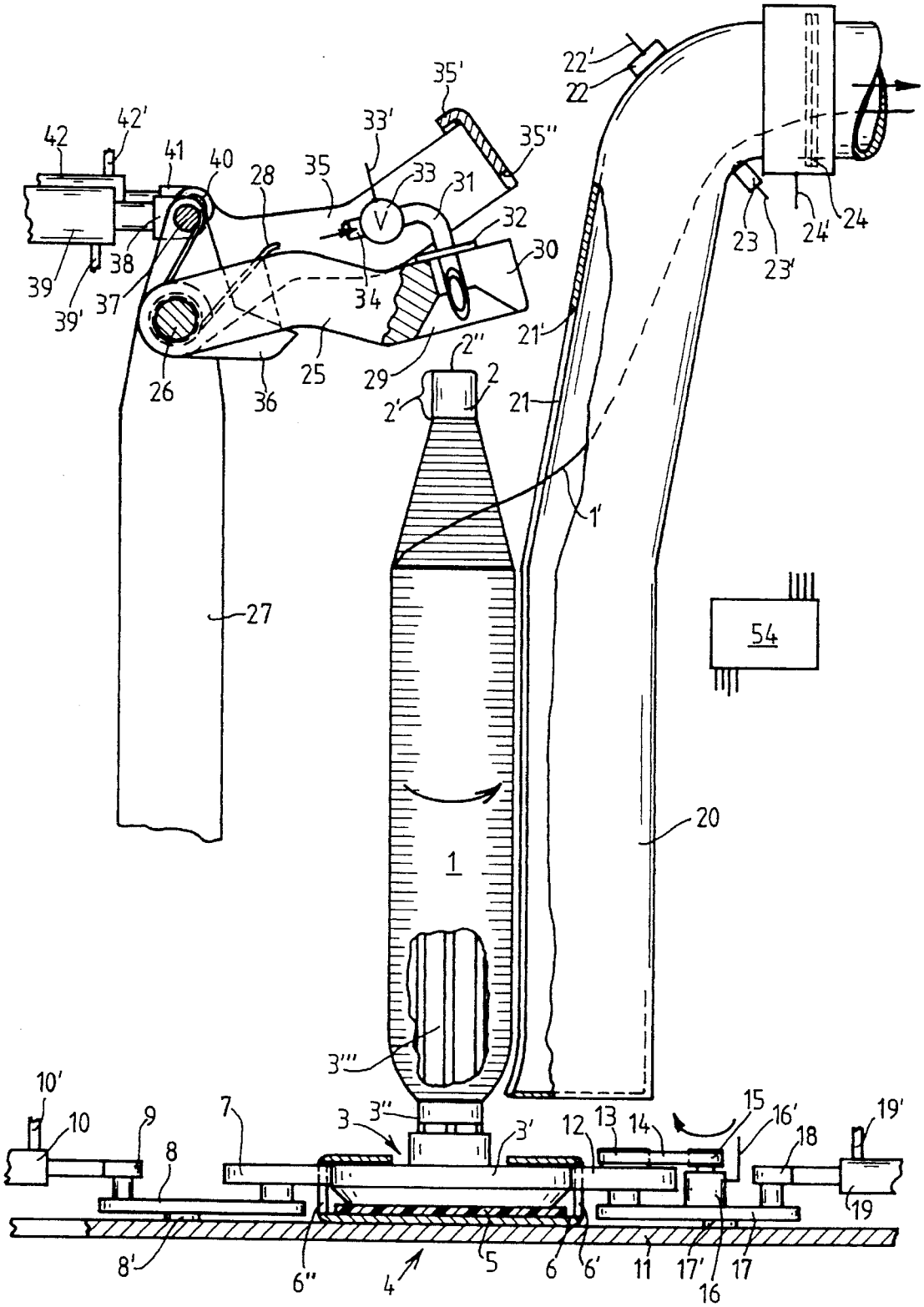
FIG. 1 is a side elevational view of a cop preparation station with associated cop transport device, cop drive device, and yarn grasping and yarn depositing devices in a starting position ready for a cop preparation operation.

Referring now to the accompanying drawings and initially to FIG. 1, a cop preparation station is shown according to one embodiment of the present invention, wherein a cop 1 is shown in the process of its yarn end being aspirated into a suction tube 20. The cop 1 is supported in upstanding disposition on an arbor 3''' of a pallet 3. The pallet 3 rests with its base plate 3' on a conveyor belt 5 of a conveyor mechanism 4. A shoulder 3'' is provided between the base plate 3' and the arbor 3''' which, among other things, is used for guidance of the pallet 3 within a guide channel 6 of the conveyor 4. At the cop preparation station, the guide channel 6 has openings 6' and 6'' on its opposite sides, through which extends a drive means for the rotary driving of the pallet 3.

While the actual driving of the cop 1 takes place on one side of the conveyor 4 by means of drive rollers 12,12' (see FIG. 3 in particular), a single idler roller 7 on the opposite side of the conveyor 4 rests at the same height against the base plate 3' of the pallet 3 to assure that the base plate 3' is held pressed against the drive rollers 12 and 12' in order to assure a dependable frictional drive of the drive.

The drive rollers 12,12' and a motor 16 are disposed on a common pivot plate 17 on which the rollers 12,12' are rotatably seated and are fixedly connected coaxially to respective pulleys 13,13'. A drive belt 14 extends around the pulley 15 of the motor 16 and the two pulleys 13,13' of the drive rollers 12,12', for synchronized driving of the two rollers 12,12' is assured. The motor 16 is connected via a control line 16' with a control device 54, by means of which the direction of rotation as well as the speed (rpm) of the drive rollers 12,12' can be accurately controlled.

The pivot plate 17 is pivotably fixed about a pivot shaft 17' which is fastened on a base plate 11 of the bobbin winding machine. A rotary joint 18 is attached to the pivot plate 17 and is connected with the piston of a fluid cylinder 19 having a fluid connector 19' which is connected via a valve (not shown) with a fluid source. The valve is also actuated by the control device 54. Thus, the pivot plate 17 can be retracted from the active drive position represented in FIGS. 1 and 3 by actuating the fluid cylinder 19, so that the drive rollers 12,12' are withdrawn from the opening 6' in the guide channel 6 out of the area of the conveyor 4 thereby leaving the conveyor channel 6 free of obstructions to the conveyance of the pallet 3 and the cop 1.

The idler roller 7 is mounted on a similar pivot mechanism at the opposite side of the conveyor 4, having a pivot plate 8 pivotable about a pivot shaft 8' which is mounted in the base plate 11. The pivot plate 8 is connected via a rotary joint 9 with the piston of a fluid cylinder 10 which has a fluid connector 10' which is also connected with a valve (not shown) actuated by the control device 54.

The drive rollers 12,12' and the idler roller 7 define an operative yarn end preparation position for cops at the cop preparation station. The suction tube 20 is disposed at the cop preparation station adjacent to the operative yarn end preparation position to be directly next to the cop 1. The suction tube 20 has a suction slit 21 extending over the axial length of the cop such that the upper end 21' of the slit 21 lies above the level of the cop nose 2' or the upper edge of the tube 2.

In the illustration of FIG. 1, the yarn end 1' from the cop 1 is shown to have already been aspirated through the suction slit 21 of the tube 20. This yarn end 1' is thusly detected by a photodiode 22, opposite which a light source 23 is placed. The light source 23 is energized via a power supply line 23'. The photodiode 22 reports the interruption or weakening of the impinging light caused by the passage of the yarn end to the control unit 54 via a signal line 22'.

A yarn cutting device 24 is disposed within the suction tube 20 downstream of the photodiode 22, as viewed in relation to the air flow direction in the suction tube 20, which can also be controlled by the control device 54 via a control line 24'.

A shaft 26 is fastened to a support 27 disposed on the opposite side of the conveyor 4 from the suction tube 20, about which a shaft 26, a centering flap 25, a dog 36, and a frame 35 are pivotably mounted independently of each other. However, by interlocking engagement with the centering flap 25, the dog 36 can cause integral movement of the centering flap 25 in a counterclockwise direction (as viewed in FIG. 1). In the clockwise direction, unitary movement of the dog 36 and the centering flap 25 is accomplished by frictional connection of these components by means of a spring 28 affixed to a bolt 37 extending from the dog 36 and directly to the centering flap 25. This means a transferring movement permits biased yielding of the flap 25 from the dog 36 in order to prevent the respective tube 2 from being damaged in case of excessive tolerances in the performance of pivoting movement in of the cop length.

The bolt 37 is connected with a piston head 38 which is seated on the free end of a piston of a fluid cylinder 39. The fluid cylinder 39 has a fluid connector 39' which is supplied via a valve (not shown) which can also be controlled by the control device 54. Thus, it is possible in this manner to pivot the centering flap around the shaft 26 by means of the fluid cylinder 39 acting on the dog 36.

Figure 2:
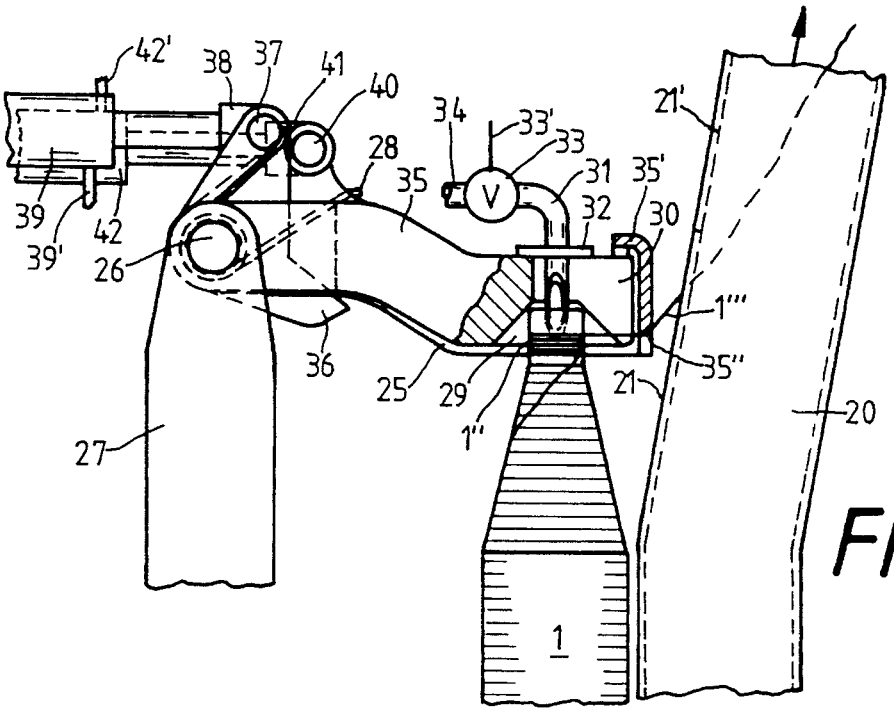
FIG. 2 is a partial side elevational view similar to FIG. 1 showing a cop at the preparation station with nose windings having already been placed on the cop by means of the grasped yarn end.
Figure 3:
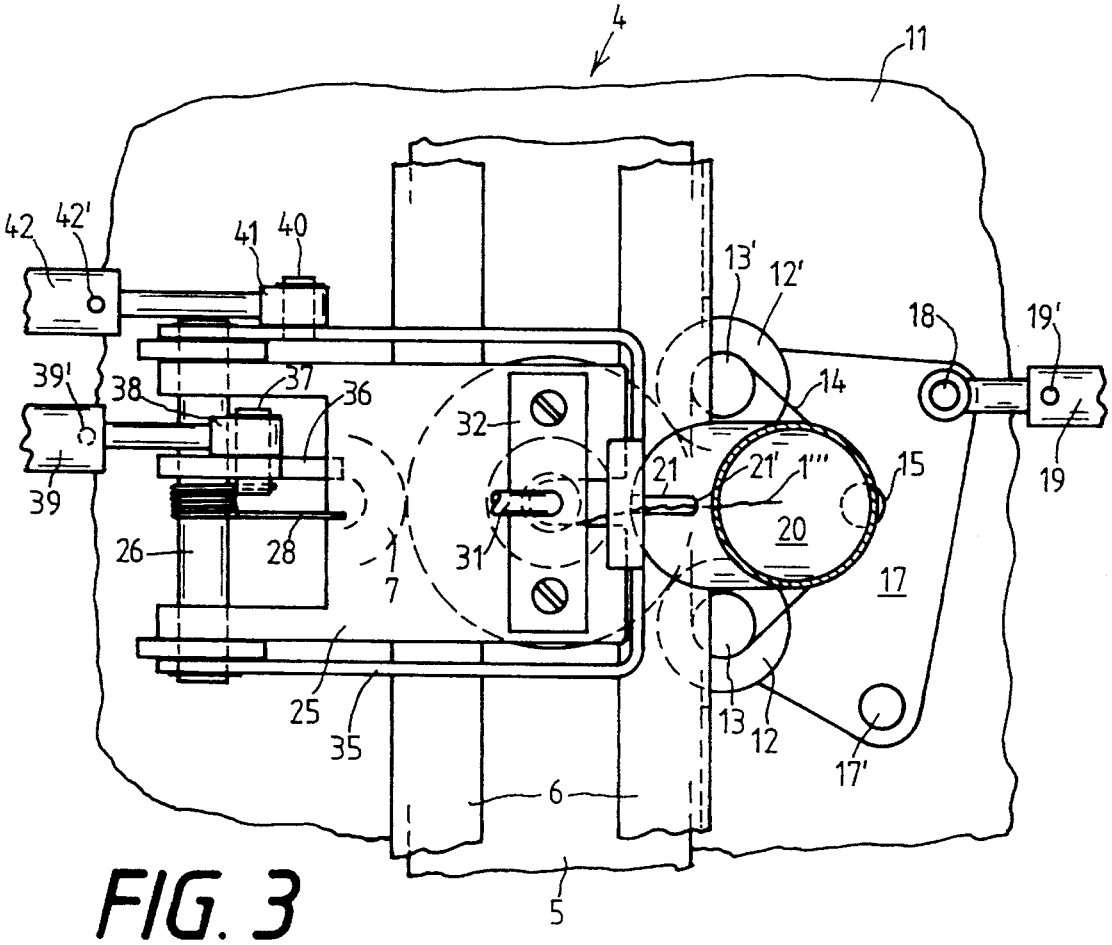
FIG. 3 is a top plan view of the corresponding station of FIG. 2.

The frame 35 is of a configuration and size that it is pivotable outwardly about the centering flap 25 without touching it (see FIG. 3). The frame 35 includes a guide contour 35'' on its outward end located opposite the pivot shaft 26, thereby forming a yarn guiding means for guiding engagement with the yarn. An angled element 35' of the frame 35 is resiliently rests on the centering flap 25 in the lower position of the frame 35 (FIG. 2).

The frame 35 is connected by a bolt 40 with a piston head 41 which is attached to the free end of a piston of a fluid cylinder 42. The fluid cylinder 42 can also be controlled via the control device 54 through fluid connector 42' and a valve. The separate fluid cylinders 39 and 42 assure a separate control of the centering flap 25 and the frame 35.

The underside of the centering flap 25 has a conical recess 29, which in its operative position downwardly facing the conveyor belt 5, as shown in FIG. 2, receives the upper end of the cop 1, while additionally serving as a yarn retaining means after nose windings 1'' of the yarn 1' (FIG. 4) have been placed, as hereinafter described.

An arbor 31 is fastened by means of a holder 32 on the centering flap 25 and is tubular in configuration for use as a blower nozzle. The arbor 31 has an obliquely cut end opening 31' which, in the lowered position of the centering flap 25, projects into the interior of the cop tube 2. The tubular hollow interior of the arbor 31 is connected with a compressed air line 34 via a valve 33 which is controlled via a control line 33' by the control device 54.

The cop 1 is placed on the arbor 3''' of a pallet 3 and is transported along the conveyor 4 into the cop preparation station by means of the conveyor belt 5. The arrival of this transport unit at the cop preparation station is detected by means of a sensor (not shown) and the pallet 3 is subsequently stopped by an appropriate stopping device at the cop preparation station actuated by the sensor. However, it is also possible to utilize the oppositely located idler and driver rollers 7 and 12,12' simultaneously as a stopping device by precisely timed control of their associated fluid cylinders 10,19. In either case, the pallet 3 is then exactly positioned at the station by pivoting the pivot plates 8 and 17, which is particularly seen in FIG. 3.

Following the establishment of proper contact of the rollers 7 and 12,12' with the circumference of the base plate 3' of the pallet 3, the motor 16 is actuated via the control line 16' by the control device 54 causing the two drive rollers 12,12' to rotate via the belt 14 and, in turn, causing the cop 1 to be rotated about its longitudinal axis. It is advantageous for transmitting the rotary movement from the pallet 3 to the cop 1 if the arbor 3''' of the pallet 3 is provided with resilient support elements on its circumference, which improve the frictional engagement between the tube 2 and the arbor 3'''.

Initially, the cop 1 is turned opposite to the yarn winding direction. The cutting device 24 in the suction tube 20 is opened at the same time, which usually is simultaneously used as a blocking flap for the suction air. Suction is thereby appropriately applied to the periphery of the cop 1 through the slit 21, so that the end 1' of the yarn thereon can be aspirated through this suction slit 21 by the suction tube 20. The yarn end 1' is sucked progressively into the suction tube 20 and passes the photodiode 22, which detects and reports the grasping of the yarn end 1' to the control device 54 via the signal line 22' as aforedescribed. The motor 16 is stopped thereupon to prevent further unwinding of yarn from the cop 1. The cutting device 24 is subsequently actuated, by means of which the length of yarn pulled off the cop 1 is clearly defined by the distance from the cutting device 24.

However, it may be desirable to vary this yarn length according to the predetermined number of nose windings 1" to be formed and in relation to the diameter of the tube 2 of the cop 1. A longer yarn end 1' can be provided by continuing to turn the cop 1 in the yarn unwinding direction after the cutting device 24 has been actuated, and immediately opening the cutting device again following cutting, thereby re-establishing the application of suction air to the yarn end. The number of turns of the cop following cutting determines the additional length of the yarn end 1' sucked into the tube 20. Care should be taken in every case that the yarn end 1''' remaining after placing the nose windings 1" (as hereinafter described) is not long enough to reach the arbor 3''' of the pallet 3 upon insertion of the yarn into the cop tube in order to prevent the jamming of this yarn end.

Following the cutting to length of the yarn end 1', the two fluid cylinders 39 and 42 are actuated to pivot the centering flap 25 and the frame 35 in a clockwise direction into the positions shown in FIGS. 2 or 3. Notably, however, the instant construction also makes it possible to actively operate only the fluid cylinder 42, while the centering flap 25 is caused to move as a unit therewith by engagement of the angled element 35' of the frame 35 with the flap 25.

Once the operative position of the centering flap 25 and the frame 35 illustrated in FIGS. 2 and 3 has been attained, the motor 16 is again actuated via the control line 16', but in this case, the motor is caused to rotate in an opposite direction to rotate the cop 1 in the winding direction of the yarn thereon. The aspirated length of yarn is deflected over a guide contour 35" of the lowered frame 35 such that the yarn is placed in the form of nose windings 1" on the nose portion 2' of the cop tube, as can be seen from FIG. 2.

Figure 4:
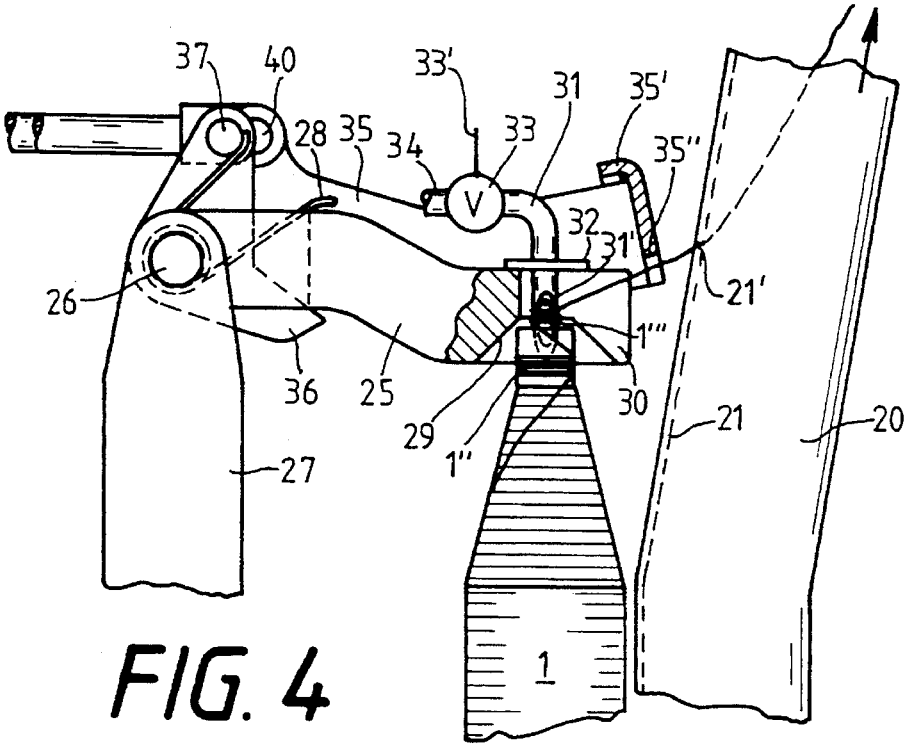
FIG. 4 is another partial side elevational view similar to FIG. 2 illustrating the application of yarn windings on an arbor forming a nozzle positioned above the nose of the cop tube.

Subsequently, as represented in FIG. 4, while the direction of rotation of the cop 1 is maintained, the frame 35 is pivoted counterclockwise back into its original rest position. In the course of this movement, the piston of the fluid cylinder 39 must remain extended in order to keep pressing the conical recess 29 of the centering flap 25 against the upper end edge 2" of the cop tube by means of the spring 28. As a result, the yarn end 1' extends from the area of the nose windings 1" as far as a clamping point between the upper end edge 2" of the tube and the conical recess 29 and therefrom through a forward opening 30 of the centering flap 25 directed into the suction tube 20 about a deflection edge 21' of the suction slit 21. Thus, by continuing the rotation of the cop 1, the yarn is wound onto the obliquely cut portion of the arbor 31 about the opening 31". The valve 33 is actuated via the control line 33' after a defined period of time to connect the tubular arbor 31 to the compressed air line 34 thereby causing the arbor 31 to function also as a nozzle.

Figure 5:
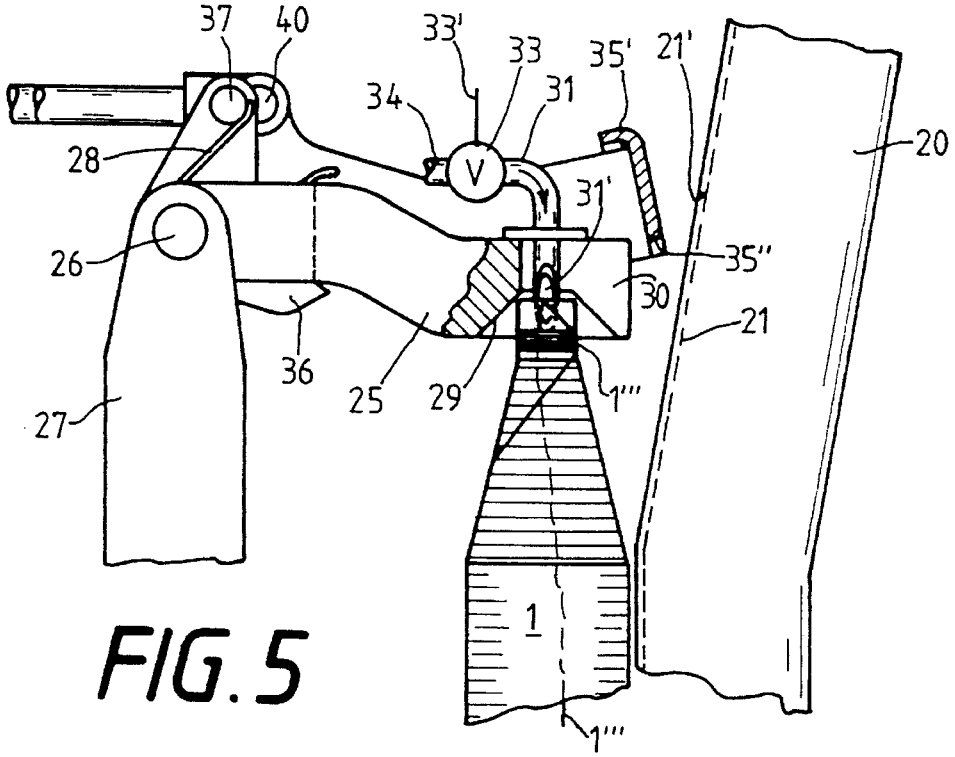
FIG. 5 is a partial side elevational view similar to FIG. 4 but after the yarn end wound on the arbor has been blown into the cop tube.

As can be seen from FIG. 5, the delivery of compressed air into the arbor 31 causes the yarn end portion 1''' wound about the arbor 31 to be loosened in the area of the opening 31' and to be blown into the interior of the adjacent cop tube. As seen in FIG. 1, the arbor 3''' of the pallet 3 is ribbed so that this air can exit above the base 3" of the pallet 3 between the ribs of the arbor 3''' and the tube 2. However, even if such air vents are not provided, a dependable insertion of the yarn end 1''' is still assured by controlling the amount of air blown into the cop tube.

Figure 6:
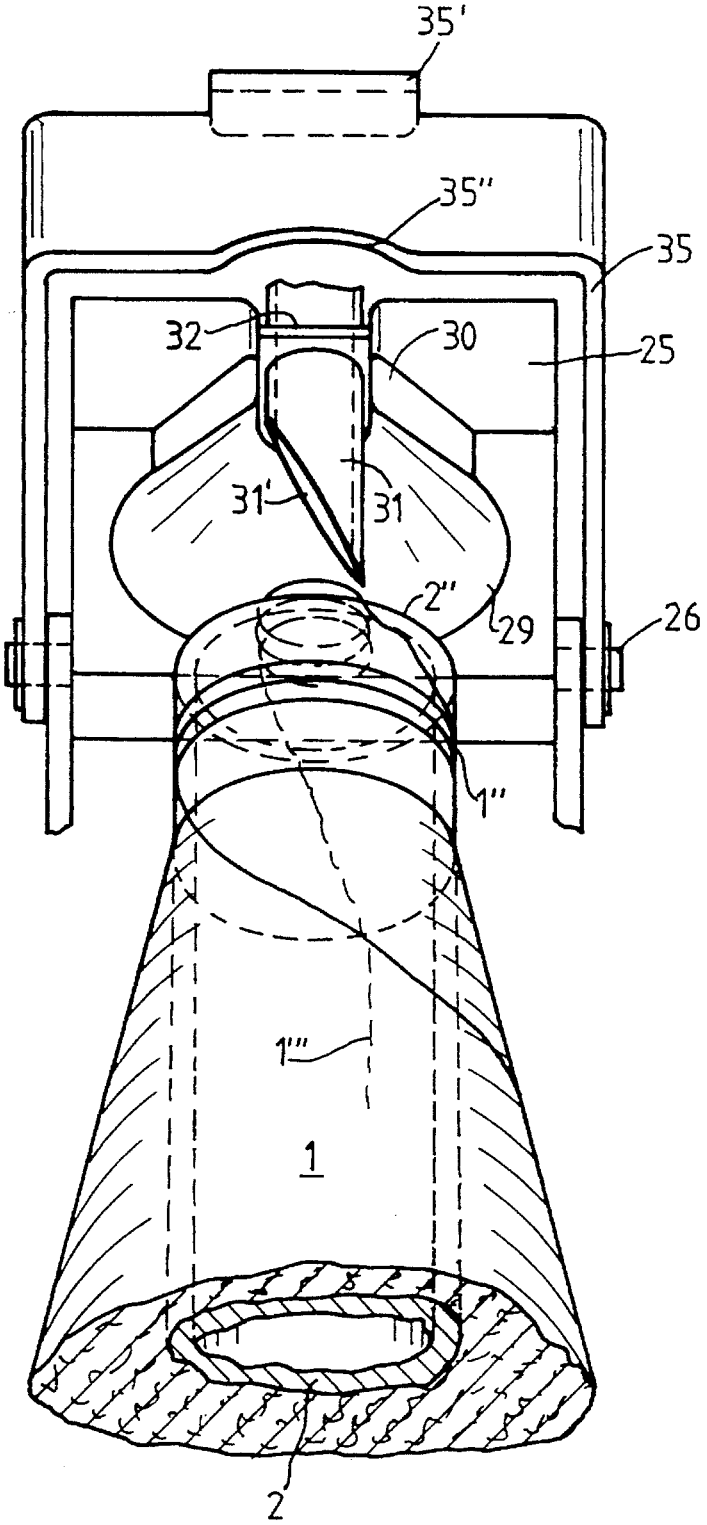
FIG. 6 is an enlarged perspective view representing the operational step shown in FIG. 5.

An enlarged perspective representation is shown in FIG. 6 to illustrate the next operational step in which the centering flap 25 is upwardly pivoted to return into its initial position. It can also be seen here that there is no loop of yarn between the nose windings 1" and the succeeding yarn end 1''' inserted into the cop tube but instead the yarn extends directly over the upper edge 2" of the tube.

Figure 7:
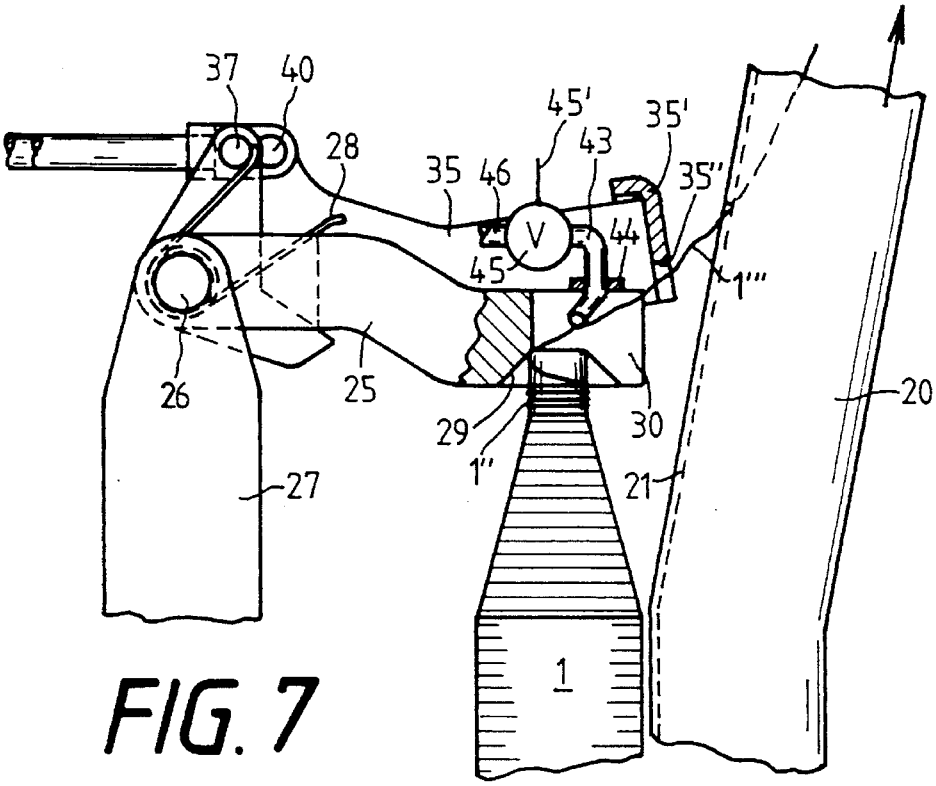
FIG. 7 is a partial side elevational view of a cop preparation station according to an alternative embodiment of the present invention having a yarn blowing nozzle disposed obliquely above the cop being prepared, instead of the arbor-forming nozzle of FIGS. 1–6.

An alternative embodiment of the present invention is shown in FIG. 7, in which the arbor 31 for projecting axially into the interior of the cop tube has been omitted and replaced with an air nozzle 43 attached to the centering flap 25 by means of an attachment plate 44 to be disposed at a laterally oblique inclination to a cop tube 2 at the preparation station. The remaining moving parts of this device are identical to the first exemplary embodiment of FIGS. 1–6. The operational step illustrated in FIG. 7 corresponds to the step shown in FIG. 4 in connection with the first embodiment. In this case, after the placement of the nose windings 1" on the nose portion 2' of the cop 2, the yarn end portion 1''' extends in a straight line through the opening 30 of the centering flap 25 into and through the suction slit 21. By continued rotation of the cop 1 in the winding direction the yarn comes to rest obliquely in the form of a chord across the upwardly facing opening into the tube 2. Thereupon, a valve 45 in the nozzle 43 is triggered via a control line 45' by the control device 54 to connect the nozzle 43 with a compressed air line 46 at the time when the yarn assumes the described position across the tube opening, causing the remaining yarn end portion 1'''to be blown into the tube interior by the nozzle 43. In this embodiment, the inclination of the nozzle 43 has been selected to effect a withdrawal action on the yarn portion 1''' still remaining in the suction slit 21.

Figure 8:
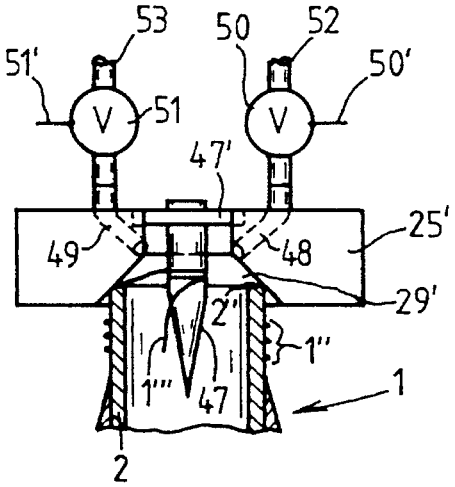
FIG. 8 is a partial side elevational view of a cop preparation station according to another embodiment of the present invention equipped with a centered arbor above the cop being prepared and oppositely disposed blower nozzles.

In the further embodiment of the invention shown in FIG. 8, a yarn winding arbor 47 similar in function to the arbor 31 of FIGS. 1–6 is fastened by means of a holder 47' on the centering flap 25' but, in contrast to the first embodiment, this arbor 47 is not tubular or otherwise configured to function as a nozzle. Blowing of the yarn from the arbor 47 is accomplished in this embodiment by oblique nozzle bores 48,49 formed in the centering flap 25' and connected respectively via valves 50 and 51 to compressed air lines 52 and 53. The valves 50 and 51 can be controlled by the control device 54 via control lines 50' and 51'. The terminal ends of the nozzle bores 48,49 open into the conical recess 29' of the centering flap 25' at a height and at an angle such that the flow of the compressed air is directly placed on the yarn windings placed on the arbor 47.

It should be noted that the number of yarn windings placed on an arbor 31,47 can be selectively varied in accordance a particular winding operation. For example, it is easily possible to wind the yarn less than once around the arbor and then to blow the partial yarn winding off the arbor. In this case, the arbor only has the function of holding at least a part of the yarn precisely over the longitudinal axis of the tube. However, if there is a comparatively large cop into which it is possible to blow a longer yarn piece, it is advantageous to collect yarn in the form of several windings on the arbor in order to assure an accelerated transfer of these yarn ends into the tube interior.

Even though the invention has been described with particular reference to the use of blower devices for inserting into a cop tube the yarn end portion remaining after formation of nose windings, it is to be understood that the substance of the invention does not preclude the aspiration of the yarn end into a pallet through an air duct.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for prepositioning a yarn end on a tubular spinning cop in preparation for subsequent unwinding in a bobbin winding machine, comprising a drive for rotating the cop about its longitudinal axis at a cop preparation station, a suction nozzle stationarily disposed at the cop preparation station for aspirating and holding the yarn end, the nozzle having a yarn receiving slit extending lengthwise of the cop to a terminal end of the slit axially beyond a nose portion of the cop, a cutting device for cutting the yarn end to length, a yarn guide means for delivering a first portion of the yarn end to the nose portion of the cop for placing nose windings of the yarn thereabout, the yarn guide means being movable relative to the cop at the cop preparation station between an inactive position spaced axially from the nose portion of the cop and an active position generally alongside the nose portion of the cop, means for inserting a remaining portion of the yarn end into a tubular interior of the spinning cop, yarn retaining means selectively movable into and out of contact with the nose portion of the cop and having an opening for delivery of the yarn end therethrough to the nose portion of the cop, and means for controlling movement of the yarn guide means into the active position during placement of nose windings about the nose portion of the cop and the inactive position after placement of the nose windings and for controlling activation of the yarn inserting means and movement of the yarn retaining means out of contact with the nose portion of the cop after movement of the yarn guide means into the inactive position.

2. An apparatus for prepositioning a yarn end on a tubular spinning cop in accordance with claim 1 wherein the yarn inserting means comprises a nozzle for blowing air into the tubular interior of the spinning cop.

3. An apparatus for prepositioning a yarn end on a tubular spinning cop according to claim 2 wherein the blower nozzle is oriented to direct blown air along an oblique axis inclined to the opening of the yarn retaining means.

4. An apparatus for prepositioning a yarn end on a tubular spinning cop according to claim 1 wherein the yarn inserting means comprises an arbor selectively positionable in alignment with the tubular interior of the cop for temporarily winding thereabout the remaining portion of the yarn end.

5. An apparatus for prepositioning a yarn end on a tubular spinning cop according to claim 4 wherein the arbor includes a nozzle for blowing air into the tubular interior of the cop, the arbor defining an oblique air discharge outlet for winding thereabout of at least a part of the remaining portion of the yarn end.

6. An apparatus for prepositioning a yarn end on a tubular spinning cop according to claim 4 wherein the yarn inserting means further comprises a pair of opposing nozzles for blowing air onto the remaining portion of the yarn end and toward the tubular interior of the spinning cop to entrain and deliver the remaining portion of the yarn end into the tubular interior of the cop.

7. An apparatus for prepositioning a yarn end on a tubular spinning cop according to claim 1 wherein the yarn inserting means is fixedly connected with the yarn retaining means.

8. An apparatus for prepositioning a yarn end on a tubular spinning cop according to claim 1 wherein the yarn retaining means comprises a cop centering flap having a conical recess for centering engagement with the nose portion of the cop.

9. An apparatus for prepositioning a yarn end on a tubular spinning cop according to claim 1 wherein the yarn guide means and the yarn retaining means are independently disposed pivotably about a common shaft.

10. An apparatus for prepositioning a yarn end on a tubular spinning cop according to claim 1 wherein the cop preparation station is disposed along a conveyor for transporting spinning cops each in upstanding disposition on an arbor of a cop pallet and the drive is selectively movable into and out of driving contact with the pallets on the conveyor.

11. An apparatus for prepositioning a yarn end on a tubular spinning cop according to claim 10 wherein the drive includes means for reversing the direction of rotation of the cop for sequential aspiration of the yarn end with the suction nozzle and placement of the yarn end on the nose portion of the spinning cop.

12. An apparatus for prepositioning a yarn end on a tubular spinning cop according to claim 1 wherein the drive is connected with the controlling means for selective setting of the driven speed of the cop.

* * * * *